US006481398B2

(12) United States Patent
Uchiyama

(10) Patent No.: US 6,481,398 B2
(45) Date of Patent: Nov. 19, 2002

(54) HIGH-LOW SPEED RANGE SWITCHING TYPE VALVE MECHANISM FOR INTERNAL COMBUSTION ENGINE

(75) Inventor: Shigenobu Uchiyama, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/683,965

(22) Filed: Mar. 7, 2002

(65) Prior Publication Data

US 2002/0139328 A1 Oct. 3, 2002

(30) Foreign Application Priority Data

Apr. 3, 2001 (JP) ..... 2001-105213

(51) Int. Cl.[7] ..... F01L 13/00; F01L 1/18
(52) U.S. Cl. ..... 123/90.16; 123/90.44
(58) Field of Search ..... 123/90.15, 90.16, 123/90.27, 90.39, 90.44

(56) References Cited

U.S. PATENT DOCUMENTS 4,768,467 A * 9/1988 Yamada et al. ..... 123/90.16
4,768,475 A * 9/1988 Ikemura ..... 123/90.16
5,413,071 A * 5/1995 Paul et al. ..... 123/90.16
5,590,627 A * 1/1997 Rygiel et al. ..... 123/90.16
5,592,907 A * 1/1997 Hasebe et al. ..... 123/90.16
6,092,497 A * 7/2000 Preston et al. ..... 123/90.16
6,186,102 B1 * 2/2001 Kosuge et al. ..... 123/90.16
6,340,010 B1 * 1/2002 Hara et al. ..... 123/90.16
6,347,606 B1 * 2/2002 Tanaka et al. ..... 123/90.16

* cited by examiner

*Primary Examiner*—Weilun Lo
(74) *Attorney, Agent, or Firm*—Ernest A. Beutler

(57) ABSTRACT

Several embodiments of variable valve lift mechanisms employing rocker arms that cooperate with high and low speed cam lobes and which are selectively coupled or uncoupled so as to operate the valve dependent upon either the low speed cam lobe configuration or the high speed cam lobe configuration. The construction is such that there are no bending loads placed on the valve stems and the actuating mechanism is relatively light and can be carried at least in part independently of the rocker arms so as to reduce the reciprocating masses and improve engine performance.

7 Claims, 6 Drawing Sheets

HIGH-LOW SPEED RANGE SWITCHING TYPE VALVE MECHANISM FOR INTERNAL COMBUSTION ENGINE

BACKGROUND OF INVENTION

This invention relates to a high-low speed range switching type valve mechanism for an internal combustion engine and more particularly to an improved and simplified arrangement for selectively varying the lift of a valve in response to engine conditions.

In order to further improve the performance of internal combustion engines in response to varying load and operating conditions, various devices have been provided for changing the effective lift of the engine valves. By changing the lift, the performance can be more closely tailored to the optimum for these various running and operating conditions. However, most of the mechanisms that have been proposed for this operation have a number of disadvantages due primarily to their complexity.

For example, one type of mechanism that has been proposed employs a pair of rocker arms each of which is associated with a given valve and each of which cooperates with a respective cam lobe having a different lift characteristic. Generally, one of these rocker arms directly operates the valve and the other rocker arm is selectively coupled to that one rocker arm or uncoupled from it to determine which cam lobe will control the valve lift characteristics.

Examples of this type of structure are shown in U.S. Pat. No. 4790274, issued Dec. 13, 1988 and now reissued as RE33411, Oct. 30, 1990; U.S. Pat. No. 4844023, issued Jul. 4, 1989 and U.S. Pat. No. 4869214, issued Sep. 26, 1989. As shown in these patents, each rocker arm is pivotally supported at one end by the engine body and has its other end engaged with the valve stem either directly or through the remaining rocker arm via a coupling mechanism. The cam lobes engage the respective rocker arms between their ends.

One disadvantage with this type of construction is that because the rocker is engaged between its ends, there is an amplified force exerted on the valve, which has a bending component. This requires the valve stem to be of greater strength and greater diameter. As a result, the valves are heavier. Accordingly the inertia of the engine reciprocating components increases and engine performance is deteriorated.

Another disadvantage with this type of mechanism is that the coupling mechanism between the rocker arms and its actuating device are all carried by one or both of the rocker arms. This further increases the reciprocating mass of the rocker arm resulting in deteriorated engine performance.

It is, therefore, a principal object of this invention to provide an improved variable valve lift timing mechanism wherein the engagement of the cam lobe with the rocker arm and valve is aligned so as to eliminate bending stresses.

Another object of this invention is to provide a variable valve lift mechanism of this type wherein not all of the components of the coupling arrangement between the rocker arms are carried by the rocker arms, thus reducing the weight of the rocker arms.

SUMMARY OF INVENTION

A first feature of the invention is adapted to be embodied in a valve operating mechanism for operating a flow controlling poppet valve of an internal combustion engine. The poppet valve has a stem portion supported for reciprocation about a valve axis in the engine for control of the flow through a port thereof by a head portion of the valve. The valve operating mechanism is comprised of a camshaft supported for rotation about a camshaft axis that is intersected by the valve axis. The camshaft has at least two cam lobes of different lift characteristics juxtaposed to the valve. A pair of rocker arms are journalled for pivotal movement about an axis offset from the camshaft axis. The rocker arms each have a follower portion engaged with a respective one of said cam lobes. One of the rocker arms has an actuating portion associated with the valve stem. An interlocking coupling selectively couples the rocker arms for simultaneous movement or permits only the one rocker arm to transmit movement to the associated valve.

Another feature of the invention is also adapted to be embodied in a valve operating mechanism for operating a flow controlling poppet valve of an internal combustion engine. In accordance with this other feature, the poppet valve has a stem portion supported for reciprocation about a valve axis in the engine for control of the flow through a port thereof by the head portion of the valve. The valve operating mechanism comprises a camshaft supported for rotation about a camshaft axis. The camshaft has at least two cam lobes of different lift characteristics associated with the valve. A pair of rocker arms are journalled for pivotal movement about an axis offset from the camshaft axis. The rocker arms each have a follower portion engaged with a respective one of the cam lobes. One of the rocker arms has an actuating portion associated with the valve stem. A coupling element is carried by one of the rocker arms and is engageable with the other of the rocker arms for selectively coupling the rocker arms for simultaneous movement or permitting only the one rocker arm to transmit movement to the associated valve. An actuating element is supported independently of the rocker arms for moving the coupling element.

DETAILED DESCRIPTION

Figure 1:
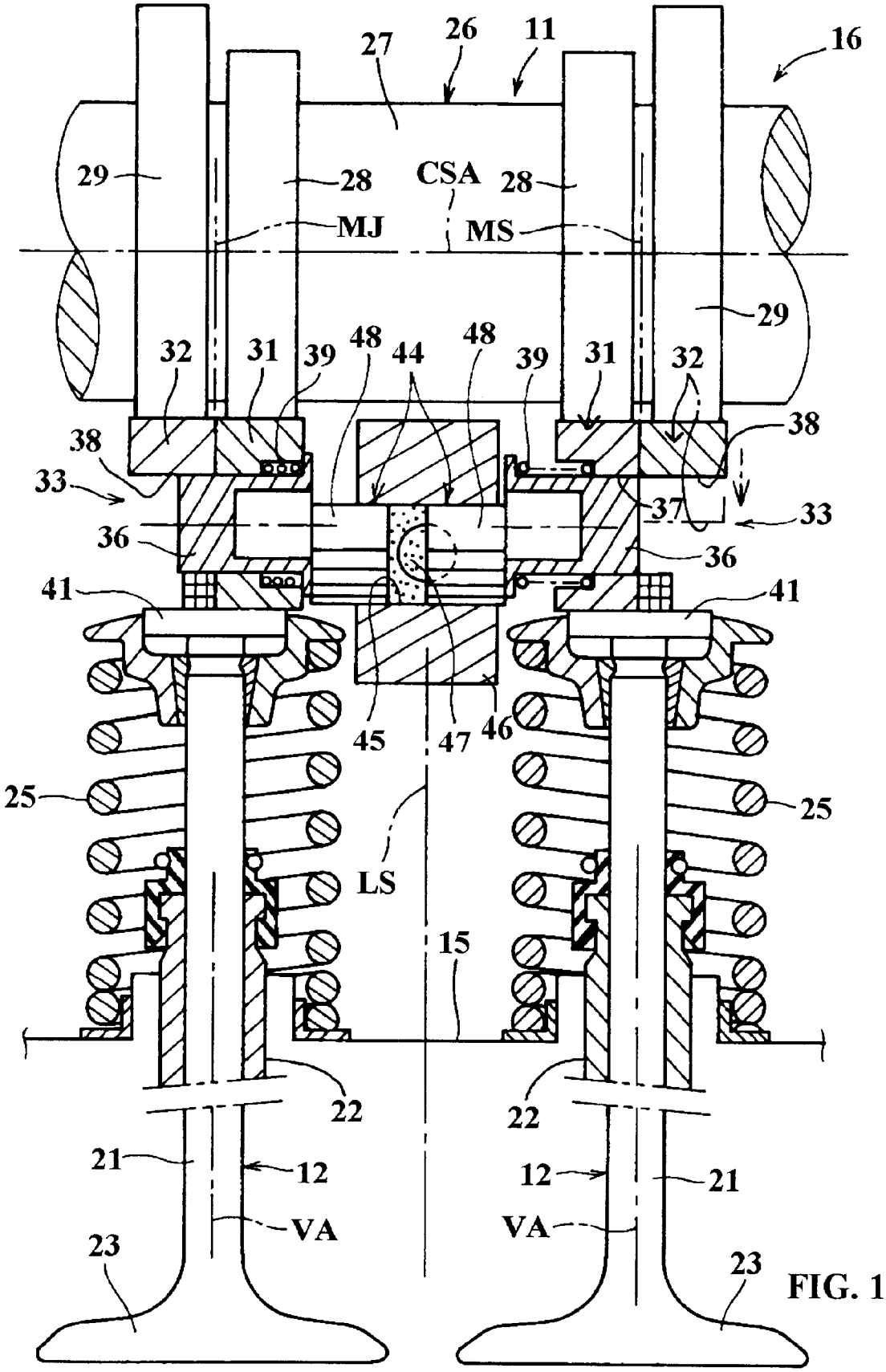
FIG. 1 is a cross sectional view of an internal combustion engine constructed in accordance with a first embodiment of the invention taken through a plane of reciprocation containing the reciprocal axes of a pair of poppet valves and the axis of rotation of the actuating camshaft.
Figure 2:
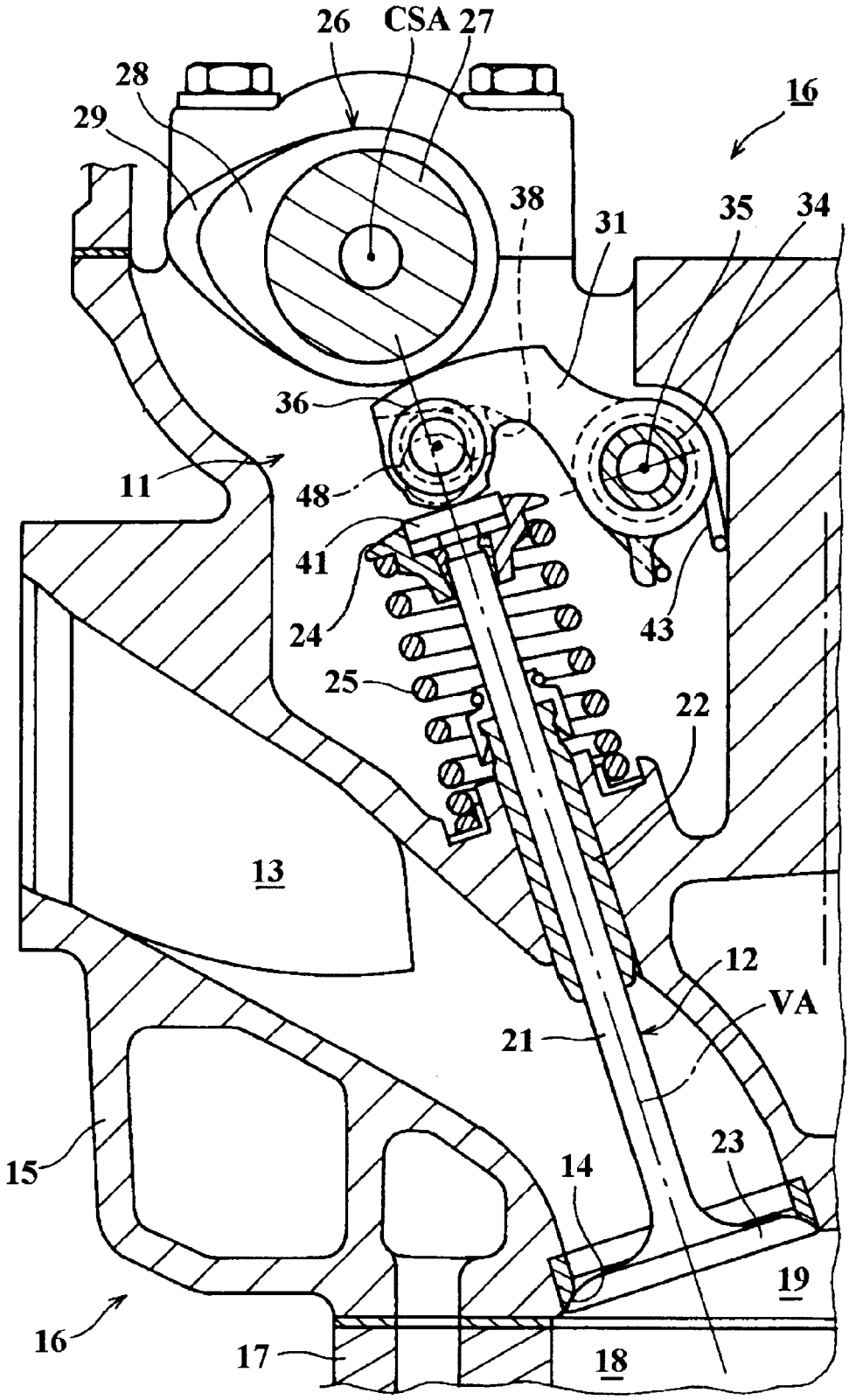
FIG. 2 is a cross sectional view taken along a plane perpendicular to the plane of FIG. 1 and through the rocker arm which directly actuates the engine valve.
Figure 3:
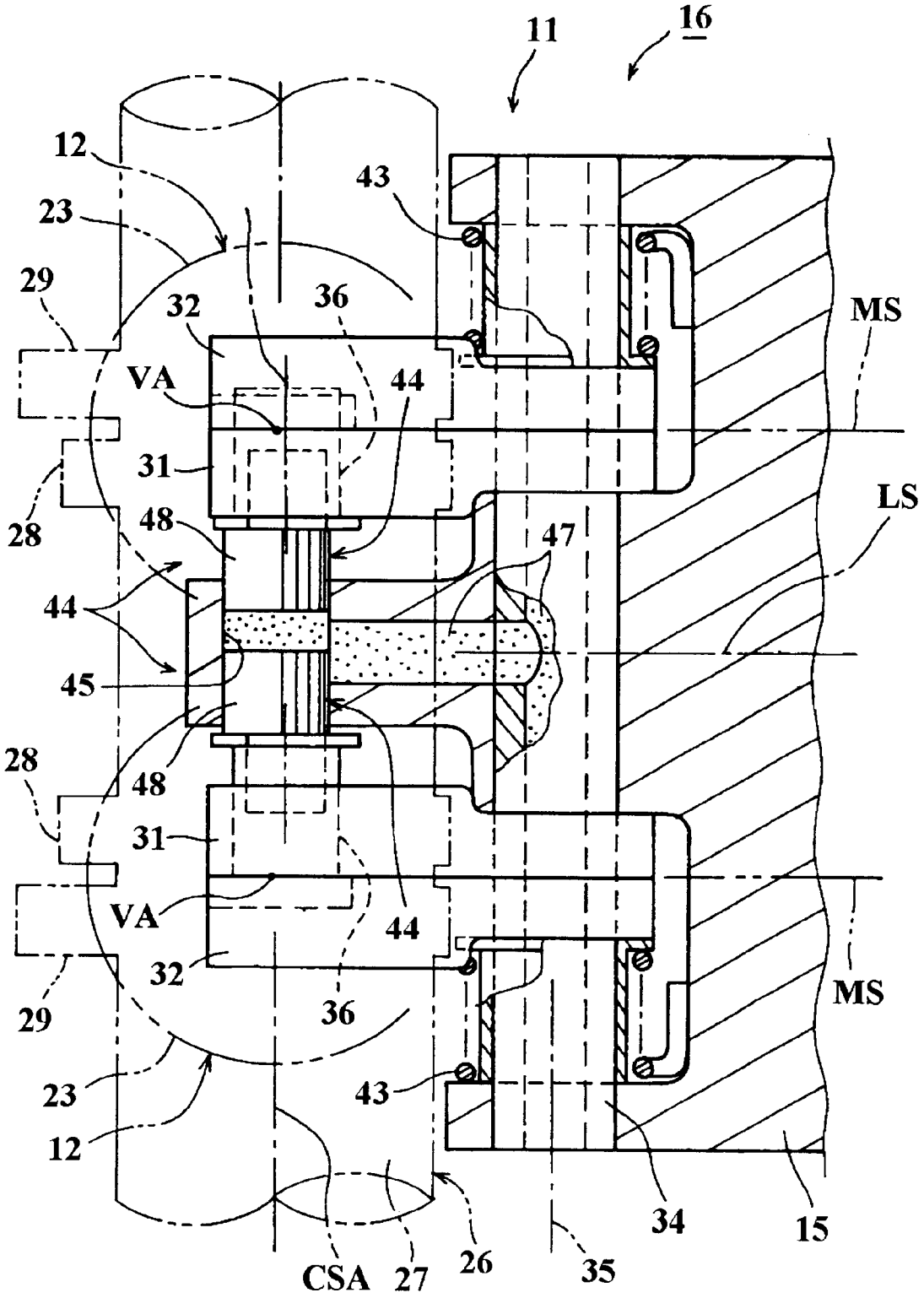
FIG. 3 is a top plane view of the structure shown in FIGS. 1 and 2 with portions broken away so as to show how the hydraulic fluid is applied to the valve lift coupling mechanism.

Referring first to the embodiment of FIGS. 1 through 3, a valve operating mechanism constructed in accordance with this embodiment is identified generally by the reference numeral 11. In the illustrated embodiment, the valve actuating mechanism 11 is shown as associated with a pair of intake valves 12 each of which serves the same engine combustion chamber through a Siamese intake passage 13 (FIG. 2). This Siamese intake passage 13 has a pair of branch portions each of which terminates at an intake valve seat 14 formed in a cylinder head 15 of an associated internal combustion engine, indicated generally by the reference numeral 16.

The cylinder head 15 is affixed in sealing relationship to an associated cylinder block 17 having one or more cylinder bores 18 and which pistons (not shown) reciprocate. The pistons are coupled to a crankshaft through a suitable driving mechanism for driving the crankshaft. Since this part of the engine is conventional, it is not illustrated. The cylinder head 15 is formed with one or more recesses 19 each of which cooperates with a respective cylinder bore 18.

The intake valves 12 are comprised of stem portions 21 that are slidably supported in valve guides 22 pressed, cast or otherwise formed in the cylinder head 15. The intake valves 12 have head portions 23 which cooperate with the valve seats 14 to control the flow into the combustion chamber recess 19 through the intake passages 13. The intake valves 12 each reciprocate about a respective valve axis VA defined by the stem portions 21 and the cooperating valve guides 22.

At their upper ends, the intake valve stems 21 carry keeper retainer assemblies 24 of any known type. The keeper retainer assemblies 24 retain one end of coil compression springs 25 that urge the valves 12 to their closed position. The other ends of the valve springs 25 act against machined surfaces of the cylinder head 15.

It has been noted that two intake valves 12 are provided for each cylinder of the engine. These valves 12 have their axes VA disposed as equal distances between a line or plane of symmetry LS. The description of structure of the valve actuating mechanism which will follow is based upon the understanding that the valve actuating mechanism 11 is symmetrically disposed around this plane LS.

The valve actuating mechanism 11 is comprised of an intake camshaft, indicated generally by the reference numeral 26 and which comprises a main shaft portion 27 that is journalled in any suitable manner for rotation about a camshaft axis CSA in the cylinder head 15. The camshaft 26 has a low speed cam lobe 28 and a high speed cam lobe 29 each associated with a respective one of the intake valves 12 and disposed on opposite sides of their valve axes VA. In FIGS. 1 and 3, the left hand side of the plane of symmetry LS shows the high lift cam operation while the right hand side shows the low lift valve operation.

The cam lobe 28 is designed for providing optimum performance under low and mid range engine running speeds and conditions and thus, provides a lower lift and, if desired, a shorter duration than the high speed cam lobe 29. The low and high speed cam lobes 28 and 29 cooperate with low and high speed rocker arms, indicated generally by the reference numerals 31 and 32, respectively. These rockers arms 31 and 32 have mating surfaces along a line MS which is disposed in coaxial relationship with the respective valve axis VA and midway between the cam lobes 28 and 29.

A coupling mechanism, indicated generally by the reference numeral 33 determines which of the cam lobes 28 and 29 control the lift of the valves 12.

In accordance with this embodiment, the low speed rocker arm 31 and high speed rocker arm 32 are both supported on a common rocker arm shaft 34 that is suitably journalled within the cylinder head 15. This rocker arm shaft defines a pivot axis 35, which is common for each of the rocker arms 31 and 32.

The coupling mechanism 33 includes a coupling element 36 which is slidably received in a bore 37 formed in the low speed rocker arm 31. This bore 37 is in line with a complimentary cylindrical surface 38 of the high speed rocker arm 32 when the valves are closed as shown on both sides of FIGS. 1 and 3. The coupling element 36 is normally biased by means of a coil spring 39 to a disengaged position shown in the right hand side of FIG. 1 and the bottom side of FIG. 3 so that it will only engage the low speed rocker arm 31.

It will be seen that the low speed rocker arm 31 has a portion that is engaged with an adjusting shim 41 positioned in the keeper retainer assembly 24 for transmitting motion to the respective intake valve 12.

When the coupling element 36 is in the position shown at the right side of FIG. 1, the high speed rocker arm 32 can continue to pivot about the pivot axis 35 during rotation of the cam shaft 26 but as shown by the phantom line view on the right of FIG. 1, this pivotal movement will not effect any operation of the valve 12.

However, the rocker arms 31 and 32 are both urged toward their engaged positions with the cam lobes 28 and 29 by hairpin or mouse trap type springs 43 (FIG. 2) so that there will not be any noise generated by this idling pivotal movement of the high speed rocker arms 32.

The coupling mechanism 33 further includes an actuator mechanism, indicated generally by the reference numeral 44 which is comprised of a cylinder bore 45 formed in a portion 46 of the cylinder head 15 disposed on the plane of symmetry LS. A hydraulic feed port 47 permits selective pressurization of the bore 45 so as to effect reciprocation of pistons 48 that are slidably supported in the bore 45. Each piston 48 has a bearing arrangement with the respective coupling element 36 and is slidably relatively thereto. This fixes the axial position of the coupling element 36 while permitting its pivotal movement around the rocker arm axis 35.

When the bore 45 is pressurized, the actuating pistons 48 will move outwardly as shown on the left hand side of FIG. 1 and cause the coupling element 36 to be engaged by the surface 38 of the high speed rocker arm 32. Hence, the coupling element 36 will be operated by this rocker arm 32 and will transmit its operation to the low speed rocker arms 31 so that the valves 12 will be opened in accordance with the lift of the high speed cam lobes 29.

By relieving the hydraulic pressure, the coupling elements 36 are moved back to their disengaged positions by the springs 39.

Hence, with this construction the actuating arrangement for the coupling mechanism 33 is not carried by the rocker arms 31 and 32 and their resulting structure is lighter in weight. Also, since the camshaft axis CSA is aligned with the valve axis VA and the follower surface of the respective rocker arms 31 and 32, there will be very direct operation without any bending loads being applied to the valve stems 21. As a result, the valve stems 21 can be made lighter in weight and this will permit higher engine speeds and engine outputs since inertia is substantially reduced and valve flow is not as likely.

It should be noted that although FIGS. 1 through 3 appear to show the operation of the two coupling mechanism 33 independently of each other, these figures merely show two different positions, one on the right and one on the left. That is, when the cylinder bore 45 is pressurized, both actuating pistons 48 will be urged outwardly to move the coupling elements 36 to the position shown on the left hand side of FIG. 1. When the pressure is released, both coupling elements 36 will be moved to the position shown on the right hand side of this figure.

Figure 4:
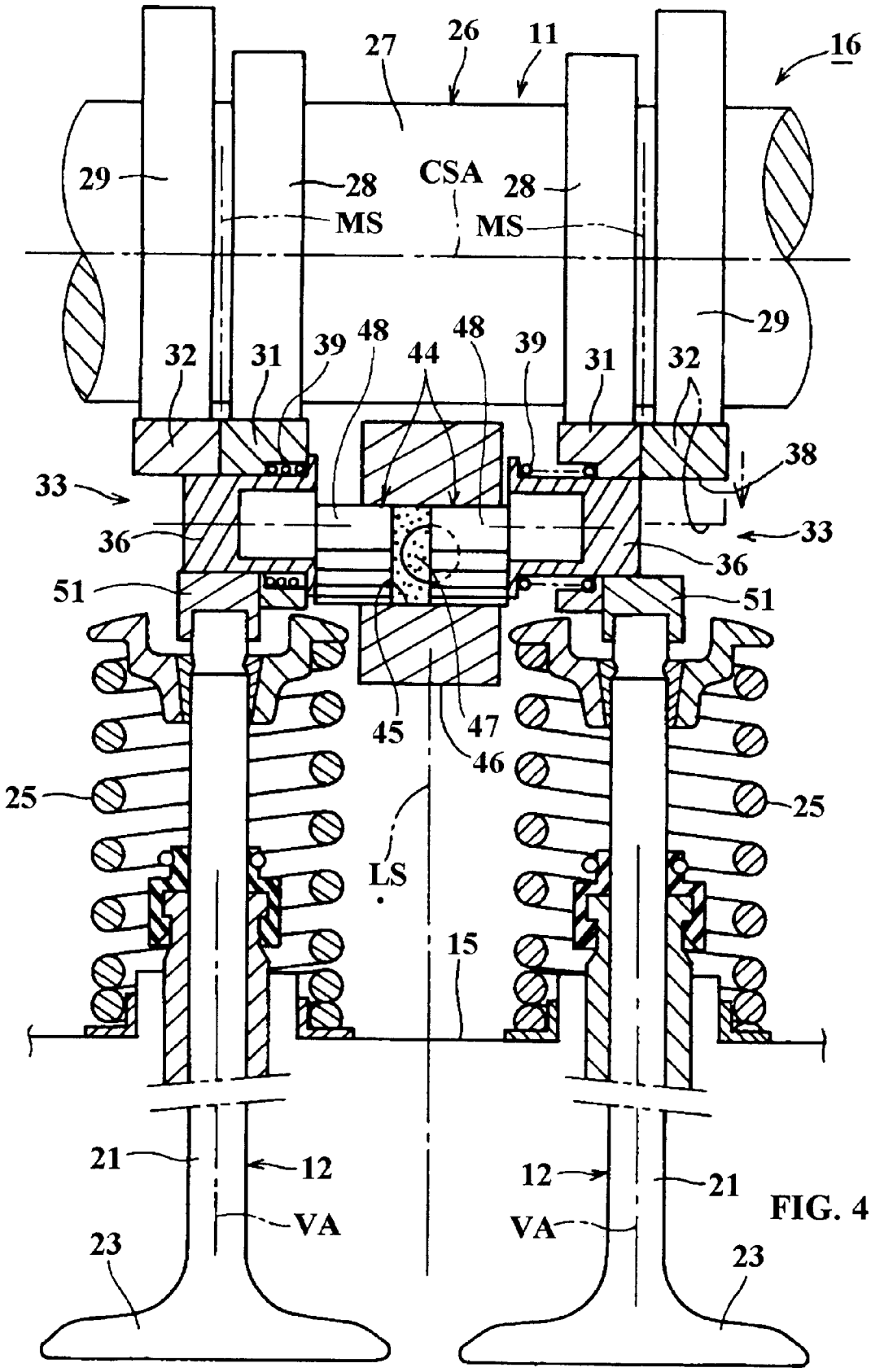
FIG. 4 is a cross sectional view, in part similar to FIG. 1, and shows a second embodiment of the invention.

FIG. 4 shows another embodiment of this invention, which is the same as the invention previously described except as will hereinafter be noted. For that reason, components which are the same have been identified by the same reference numerals and will not be described again, except insofar as is necessary to understand the construction and operation of this embodiment.

With this embodiment, rather than the low speed rocker arm 31 having a portion that engages the valve shim, the coupling element 36 itself engages the valve shim, which is indicated by the reference numeral 51 in this figure and has a slightly different configuration than the previous embodiment. This permits the use of an even lighter weight rocker arm assembly since all of the actuating loads are transferred from the high and low speed cam lobes 29 and 28, respectively to the valve stems 21 by the coupling elements 36. This offers a further performance improvement.

Figure 5:
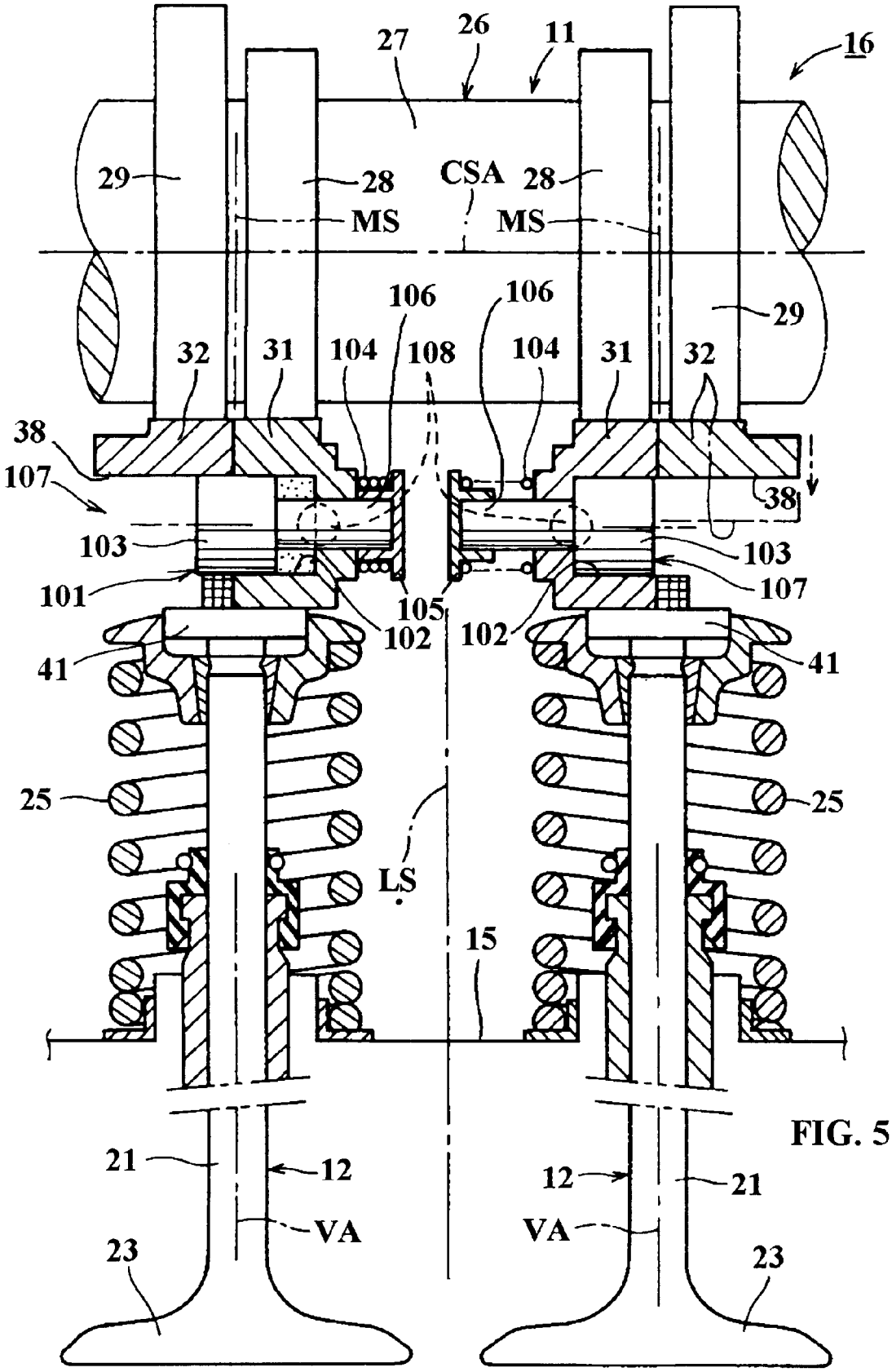
FIG. 5 is a cross sectional view, in part similar to FIGS. 1 and 4, and shows a still third embodiment of the invention.
Figure 6:
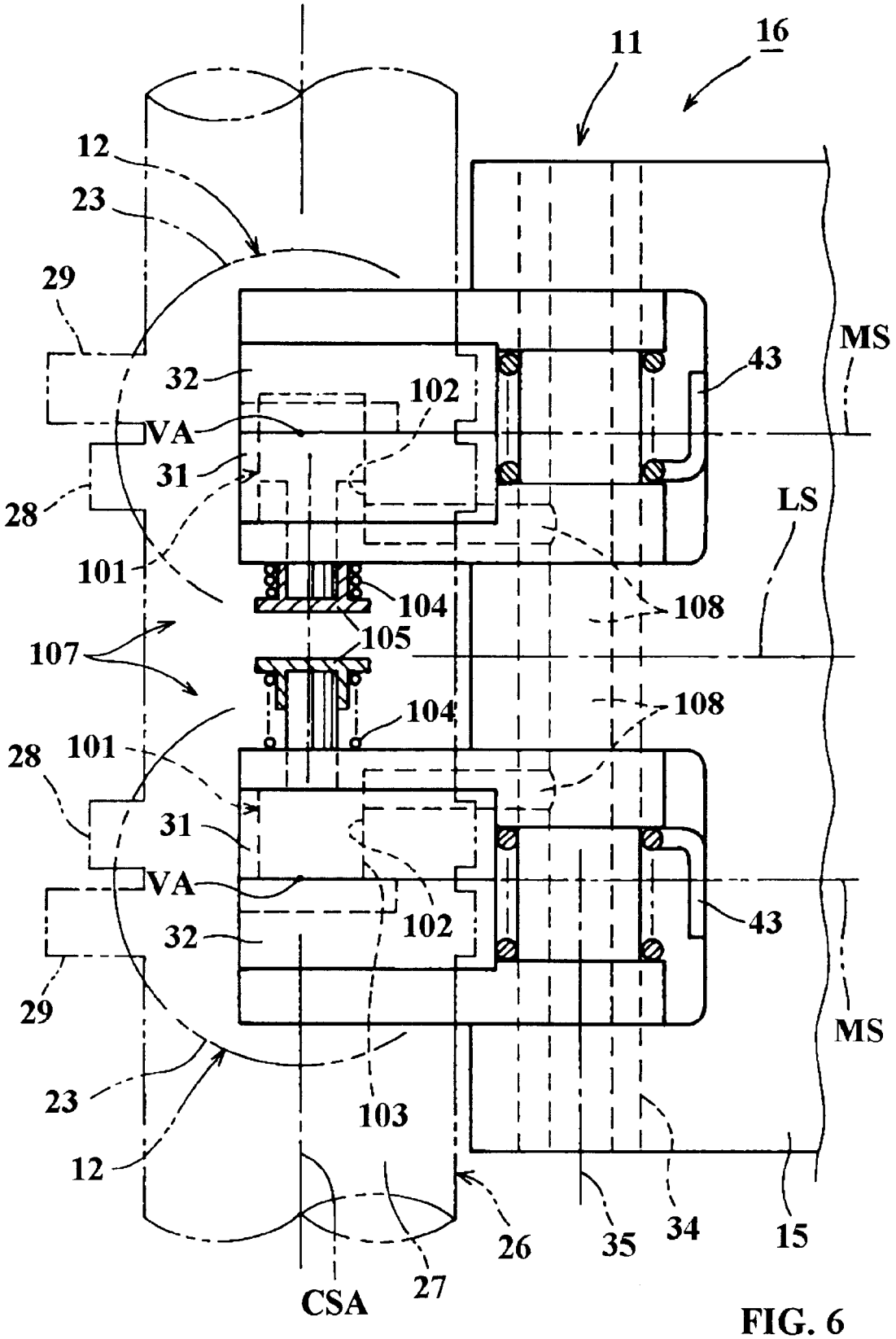
FIG. 6 is a top plane view, in part similar to FIG. 3, but shows the construction in accordance with the third embodiment of the invention.

As has been previously noted, both valves of each cylinder are actuated by either the low speed cam lobes or the high speed cam lobes respectively. FIGS. 5 and 6 shows another embodiment of the invention wherein the valves cam be operated independently of each other so that one can be operated by a high speed cam lobe and the other by the low speed cam lobe. Also, this embodiment eliminates the cylinder head portion 46 with its bore 47 for supporting the actuating pistons 48. However, in this embodiment, actuating plungers, indicated generally by the reference numeral 101 are slidably supported in bores 102 formed in the low speed rocker arms 31.

In describing this embodiment, when elements have substantially the same construction or the same construction as previously described, they are identified by the same reference numerals. In this embodiment, each plunger 101 has a piston portion 103 that is slidably supported in the rocker arm bore 102. These plunger piston portions 103 are normally urged by coil compression springs 104 that act against retainers 105 formed on the ends of piston rod portions 106 integrally formed with the actuating plunger piston portions 103. These springs 104 normally urge the coupling mechanisms, indicated by the reference numerals 107, to their disengaged positions as shown on the right hand side of FIG. 5.

The bores 102 can be selectively pressurized through feed passages 108 to urge them to their engaged position as shown on the left hand side of FIG. 1 where they are engaged by the arcuate sections 38 of the high speed rocker arms 32 so as to provide a coupling so that the high speed cam lobes 29 will control the lifts of the valves 12. However, it should be apparent that each rocker arm coupling element 107 may be operated independently of the other.

Thus, from the foregoing description it should be readily apparent that the described embodiments permit the use of rocker arm variable valve lift mechanisms without having the rocker arms exert bending loads on the valves and also wherein the weight of the individual rocker arms can be reduced since the actuating mechanism need not all be carried by the rocker arms. Of course, the foregoing description is that of preferred embodiments of the invention and various changes and modifications may be made without departing from the spirit and scope of the invention, as defined by the appended claims.

What is claimed is:

1. A valve operating mechanism for operating a flow controlling poppet valve of an internal combustion engine, said poppet valve having a stem portion supported for reciprocation about a valve axis in the engine for control of the flow through a port thereof by the head portion of the valve, said valve operating mechanism comprising a cam shaft supported for rotation about a cam shaft axis that is intersected by said valve axis, said cam shaft having at least two cam lobes of different lift characteristics juxtaposed to the valve, a pair of rocker arms journalled for pivotal movement about an axis offset from said cam shaft axis, said rocker arms each having a follower portion engaged with a respective one of said cam lobes, one of said rocker arms having an actuating portion associated with the valve stem, an interlocking coupling selectively coupling said rocker arms for simultaneous movement or permitting only said one rocker arm to transmit movement to the associated valve and an actuating element supported independently of said rocker arms and engageable with a coupling element of said interlocking coupling for controlling the movement of said interlocking coupling between the conditions where said rocker arms are coupled for simultaneous movement and only said one rocker arm transmits movement to the associated valve.

2. A valve operating mechanism as set forth in claim 1, wherein the coupling element is supported by one of the rocker arms for movement between a coupled position with the other of the rocker arms for simultaneous pivotal movement of both of said rocker arms and an uncoupled position wherein said rocker arms may pivot independently of each other.

3. A valve operating mechanism as set forth in claim 2, wherein the other rocker arm has a coupling opening for receiving the coupling element when in its coupled position.

4. A valve operating mechanism as set forth in claim 3, wherein the coupling opening of the other rocker arm is aligned with the coupling element when the poppet valve is closed.

5. A valve operating mechanism as set forth in claim 2, wherein the coupling element is biased to its uncoupled position.

6. A valve operating mechanism as set forth in claim 5, wherein the other rocker arm has a coupling opening for receiving the coupling element when in its coupled position.

7. A valve operating mechanism as set forth in claim 6, wherein the coupling opening of the other rocker arm is aligned with the coupling element when the poppet valve is closed.

* * * * *